US011851736B2

(12) United States Patent
Erlwein et al.

(10) Patent No.: US 11,851,736 B2
(45) Date of Patent: Dec. 26, 2023

(54) HARDENABLE ALUMINUM ALLOY

(71) Applicants: AMAG Rolling GmbH, Braunau am Inn Ranshofen (AT); AUDI AG, Ingolstadt (DE)

(72) Inventors: Mark Erlwein, Neudenau (DE); Heinz Werner Höppel, Erlangen (DE); Felix Glöckel, Bamberg (DE); Bodo Gerold, Simbach am Inn (DE); Stefan Pogatscher, Leoben (AT); Peter J. Uggowitzer, Ottenbach (CH)

(73) Assignees: AMAG Rolling Gmbh, Braunau am Inn-Ranshofen (AT); AUDI AG, Ingolstadt (DE)

( * ) Notice: Subject to any disclaimer, the term of this patent is extended or adjusted under 35 U.S.C. 154(b) by 845 days.

(21) Appl. No.: 16/192,928

(22) Filed: Nov. 16, 2018

(65) Prior Publication Data

US 2019/0144977 A1 May 16, 2019

(30) Foreign Application Priority Data

Nov. 16, 2017 (EP) ..... 17202190
May 28, 2018 (EP) ..... 18174637

(51) Int. Cl.
*C22C 21/10* (2006.01)
*B21D 22/02* (2006.01)
*C22F 1/053* (2006.01)

(52) U.S. Cl.
CPC ..... *C22C 21/10* (2013.01); *B21D 22/02* (2013.01); *C22F 1/053* (2013.01)

(58) Field of Classification Search
CPC ..... C22C 21/10
See application file for complete search history.

(56) References Cited

U.S. PATENT DOCUMENTS

2013/0228252 A1* 9/2013 Smeyers ..... B62D 65/02 148/537

FOREIGN PATENT DOCUMENTS

| | | | | |
|---|---|---|---|---|
| DE | 112011103667 T5 | | 8/2013 | |
| JP | 2006009140 A | * | 1/2006 | |
| WO | 2015109893 A1 | | 7/2015 | |
| WO | 2015127805 A1 | | 9/2015 | |
| WO | WO-2015127805 A1 | * | 9/2015 | ..... C22C 21/08 |

OTHER PUBLICATIONS

Espacenet Machine translation of JP-2006009140-A retrieved on Aug. 9, 2021 (Year: 2006).*
Google Patents machine translation of WO-2015127805-A1 retrieved on Aug. 9, 2021 (Year: 2015).*
Friedrich Ostermann: Applied Technologies for Aluminum [Anwendungstechnologie Aluminium], 3rd edition, publication year 2014, ISBN 987-3-662-43806-0, p. 138.

* cited by examiner

*Primary Examiner* — Keith D. Hendricks
*Assistant Examiner* — Joshua S Carpenter

(57) ABSTRACT

A temperable aluminum alloy, an aluminum sheet or strip made of such an aluminum alloy, a molded part, and a method for producing such a molded part have been disclosed. In order to enable achievement of the required yield strengths, a temperable aluminum alloy is proposed, containing zinc (Zn), magnesium (Mg), silicon (Si), tin (Sn) and/or indium (In) and/or cadmium (Cd), and optionally copper (Cu), from silver (Ag), iron (Fe), manganese (Mn), titanium (Ti), and residual aluminum as well as inevitable production-related impurities, wherein the content of magnesium (Mg) and silicon (Si) fulfills the order relation $$\frac{0.4}{\text{wt. \% Si}} - 0.15 < \text{wt. \% Mg} < \frac{0.7}{\text{wt. \% Si}} - 0.2.$$

21 Claims, No Drawings

HARDENABLE ALUMINUM ALLOY

FIELD OF THE INVENTION

The invention relates to a temperable aluminum alloy, an aluminum sheet or strip made of such an aluminum alloy, a molded part, a method for producing such a molded part, and a use of a sheet blank.

BACKGROUND OF THE INVENTION

In order to enable as aluminum sheet to have both a high deformability during forming and a strength after a baking cycle (for example in a CDP process) while simultaneously enabling low baking temperatures, DE 112011 103667 T5 proposes an aluminum alloy with 1.5 to 4 wt. % zinc (Zn), with 0.3 to 1.5 wt. % magnesium (Mg), and with 0 to 0.5 wt. % silicon (Si). The aluminum alloys of DE112011 103667 T5 have a comparatively high precipitation pressure, for example in $Mg_2Si$ phases, which does in fact have a strength-increasing effect, but disadvantageously does not permit a sheet-forming with a low first yield strength $R_{p0.2}$ of for example at most 160 MPa. It is therefore not possible to produce molded parts with a comparatively complex geometry—of the kind required for example in vehicle parts, preferably vehicle body parts, in particular the body shell.

The stated object of the invention, therefore, is to provide an aluminum alloy, which nor only has a high plastic deformability during forming, but also has a high hot tempering reaction, in particular a paint bake reaction ("paint bake response" or "PBR").

SUMMARY OF THE INVENTION

An aluminum alloy according to the invention, which is balanced in the alloy elements magnesium (Mg) and silicon (Si) relative to zinc (Zn), can permit $Mg_2Si$ phases, which have a strength-increasing effect—as a result of which the aluminum alloy, despite a comparatively low hot tempering temperature, for example baking temperature, in the T6 state, can achieve a second yield strength $R_{p0.2}$ of at least 250 MPa. The aluminum alloy can therefore feature a comparatively high hot tempering reaction, in particular paint baking reaction ("paint bake response" or "PBR").

These $Mg_2Si$ phases also disadvantageously have a strength-increasing effect on an aluminum alloy in the T4 state or T4-FH state, which does not permit an—in particular cold—forming, in particular sheet-forming, with a first yield strength $R_{p0.2}$ of at most 160 MPa.

This disadvantageous effect, however, can be suppressed, both by having the alloy components magnesium (Mg), silicon (Si), and zinc (Zn) of the aluminum alloy vary within a particular contest limits and by having the magnesium (Mg) and silicon (Si) fulfill an order relation according to the claimed invention. To be precise, this ensures a sufficient, in particular also surprisingly high, solubility of vacancy-active alloy elements, namely tin (Sn), indium (In), cadmium (Cd), etc., in the solid solution of the aluminum alloy. Consequently, the aluminum alloy, which has been set according to the invention with regard to the alloy elements Mg, Si and Zn and the trace elements Sn and/or Cd and/or In, not only can fulfill the second yield strength $R_{p0.2}$, but can also ensure the first yield strength $R_{p0.2}$ in the T4 state or T4-FH state—doing so even at a comparatively low hot tempering temperature.

In addition, this aluminum alloy, which is within the content limits according to the invention, can ensure a uniform elongation $A_g$ similar to that of an aluminum alloy of the type EN AW 6016, which can ensure an outstanding plastic definability.

Consequently, the aluminum alloy according to the invention can have a particularly good suitability for a rolled aluminum sheet or strip, which can be suitable for a method for producing a molded part of a motor vehicle, preferably a vehicle body part, for example the body shell.

DETAILED DESCRIPTION OF THE PREFERRED EMBODIMENTS

In general, it should be noted that the aluminum alloy can contain inevitable production-related impurities, which can each amount to at most 0.05 wt. % and all together, can amount to at most 0.15 wt. %.

In general, it should also be noted that the term "Vehicle" is understood, for example, to include a land vehicle, water vehicle, and/or air vehicle.

In general, it should also be noted that the T4-FH state is achieved by means of a stabilization annealing treatment in which the aluminum alloy in the T4 state (solution annealing and quenching) Is subjected to a heat treatment, in particular a thermal shock. This heat treatment preferably follows the T4 treatment (solution annealing and quenching)—examples of such a stabilization annealing treatment are known from the literature (see Friedrich Ostermann: Applied Technologies for Aluminum [*Anwendungstechnologie Aluminium*], 3rd edition, publication year 2014, ISBN 987-3-662-43806-0, page 138), DE 112011 103667 T5, etc.—which is also often referred to as pre-aging treatment.

A first yield strength $R_{p0.2}$ of at most 160 MPa and a second yield strength $R_{p0.2}$ of at least 250 MPa of the aluminum alloy can be reproducibly enabled if this alloy contains 2.5 to 3.4 wt. % Zn. This is particularly the case if the aluminum alloy contains from 2.7 to 3.3 wt. % Zn. In addition, this makes it possible to also improve the solubility of the trace elements Sn and/or Cd and/or In in the solid solution of the aluminum alloy.

High strength in the T6 state despite the low baking temperature can be enabled if the aluminum alloy contains from 0.8 to 1.2 wt. % Mg, in particular from 0.85 to 1.15 wt. % Mg.

The above-mentioned advantages can be further increased if the aluminum alloy contains from 0.35 to 0.7 wt. % Si, in particular 0.4 to 0.6 wt. % Si.

A sufficient reduction of a natural aging on the one hand and a sufficient increase in the artificial aging of the aluminum alloy in the baking cycle with comparatively low baking temperatures on the other can be ensured if tin (Sn) and/or indium (In) and/or cadmium (Cd) in the aluminum alloy makes up a content of from greater than 40, in particular greater than 80, to less than 400, in particular less than 200, atomic ppm. Preferably, the aluminum alloy has a tin (Sn) and/or indium (In) and/or cadmium (Cd) content of 100 atomic ppm.

If the aluminum alloy contains from 0.15 to 0.35 wt. % copper (Cu) and/or from 0.1 to 0.3 wt. % silver (Ag) and/or from 0.05 to 0.25 wt. % iron (Fe) and/or from 0.05 to 0.12 wt. % manganese (Mn) and/or from 0.05 to 0.15 wt. % titanium (Ti) and/or from 0.02 to 0.2 wt. % tin (Sn) and/or indium (In) and/or cadmium (Cd), then it is not necessary to fear a disadvantageous influence of the setting of the aluminum alloy in the alloy elements Mg, Si, and Zn and the trace elements Sn, Cd, and/or In.

Copper (Cu), iron (Fe), and/or silver (Ag) can further increase the strength of the aluminum alloy—in particular, Fe can produce an outstanding effect in this regard.

To a certain extent, manganese (Mn) can bond to Fe in the aluminum alloy and thus reduce negative effects of iron on the plastic deformability of the aluminum alloy.

Titanium (Ti) can contribute to the grain refinement and can further increase the plastic deformability and strength.

If the aluminum alloy contains from 0.25 to 0.35 wt. % copper (Cu), then it is possible to increase the strength of the aluminum alloy—without having to fear a resulting disadvantageous influence on the setting of the aluminum alloy in the alloy elements Mg, Si, and Zn and the trace elements Sn, Cd, and/or In.

Among other things, the temperable aluminum alloy according to the can be especially suitable for an aluminum sheet or strip—for example for producing a molded part of a vehicle, preferably a vehicle body part, for example the body shell. The aluminum sheet or strip can be composed of the tempered aluminum alloy according to the invention.

This is particularly true if the aluminum sheet or strip is in the T4 state or in the T4-FH state ("fast-hardening").

An aluminum sheet or strip with a thickness of 0.5 to 4 mm, in particular from 1 to 3 mm, can also be especially suitable for producing a molded part of a vehicle.

If a molded part, in particular a vehicle part, preferably a vehicle body part, is produced from an aluminum sheet or strip according to the invention, then after an artificial aging, for example a baking cycle, preferably a paint baking cycle, this can ensure a maximum yield strength $R_{p0.2}$ and ductility.

A molded part, for example with a complex geometry and a high yield strength $R_{p0.2}$ of at least 250 MPa, can be achieved if the following method steps are carried out:

- A sheet blank is produced from the aluminum sheet or strip, for example by means of a cutting process, preferably by means of stamping,
- the molded part is produced from the sheet blank by means of an—in particular cold—forming method, in particular a sheet-metal-forming method, and
- in a subsequent step, the molded part is subjected to an artificial aging, in particular a baking cycle, preferably a paint baking cycle.

In general, it should be noted that the term "forming method" can be understood, for example, to include a deep-drawing, stretch deep-drawing, pressing, etc. in order to thus plastically alter the shape of the aluminum sheet or strip or of the sheet blank. The term "forming method" is understood to include a cold forming or semi-hot forming or hot forming, etc. Preferably a cold forming, advantageously a cold sheet forming, is used. In addition, a baking cycle, for example a paint baking cycle, can constitute the heat treatment in an electrochemical process ("bake-hardening"), e.g.: the CDP process.

Preferably, the temperature, in particular the baking temperature, during the artificial aging can be at most 165 degrees Celsius.

The advantages according to the invention in a high deformability for a complex geometry and high yield strength $R_{p0.2}$ of at least 250 MPa, for example after a baking cycle with a low baking temperature, can turn out to be particularly advantageous if a sheet blank composed of the aluminum sheet or strip according to the invention is used for the—in particular cold—forming, in particular sheet-forming, and artificial aging, in particular baking, preferably paint baking, to produce a molded part, in particular a vehicle part, preferably a vehicle body part, for example the body shell, of a vehicle.

As proof of the effects achieved, for example rolled semi-finished products, namely thin sheets, were produced from various aluminum alloys—after a week of storage at room temperature, these thin sheets in the T4-FH state were each formed into a molded part, namely a vehicle body part or body shell, by means of cold sheet forming. After the forming, these molded parts were subjected to a cathodic dip painting (CDP) with a baking cycle having a baking temperature of 165 degrees Celsius.

The compositions of the alloys tested are specified in Table 1—in addition to the alloy elements listed in this table, residual aluminum and inevitable production-related impurities are also included.

TABLE 1

Overview of the studied alloys in wt. %.

| Alloys | Zn | Mg | Si | Sn | Cu | Mn | Cr | Ag | Fe | Ti |
|---|---|---|---|---|---|---|---|---|---|---|
| 1 | 2 | 1 | 0.3 | <0.05 | <0.05 | <0.05 | <0.05 | <0.05 | <0.1 | <0.1 |
| 2 | 3 | 1 | 0.5 | 0.04 | <0.05 | <0.05 | <0.05 | <0.05 | <0.1 | <0.1 |
| 3 | 3 | 1 | 0.5 | 0.04 | 0.17 | 0.08 | <0.05 | <0.05 | 0.16 | 0.07 |
| 4 | 3 | 1 | 0.5 | 0.04 | 0.17 | 0.08 | <0.05 | 0.15 | 0.16 | 0.07 |

Alloys 2, 3, and 4 vary within the content limits according to the claimed invention. In addition, alloys 2, 3, and 4 fulfill the order relation since, in terms of the content, at 1 wt. %, their magnesium (Mg) is both less than (0.7/0.5 wt. % Si)−0.2=1.2 and greater than (0.4/0.5 wt. % Si)−0.15=0.65.

In the aluminum alloys tested, the first yield strength $R_{p0.2}$ and the uniform elongation $A_g$ of the aluminum alloy in the T4-FH state were determined after the storage at room temperature and immediately before the sheet-forming.

After the baking cycle, the second yield strength $R_{p0.2}$ and also the uniform elongation $A_g$ of the aluminum alloy in the T6 state were determined.

The measurement values obtained are summarized in Table 2.

TABLE 2

Mechanical parameters of the alloys tested.

| | T4-FH | | T6 | |
|---|---|---|---|---|
| Alloys | $R_{p0.2}$ [MPa] | $A_g$ [%] | $R_{p0.2}$ [MPa] | $A_g$ [%] |
| 1 | 120 | 20 | 210 | 17 |
| 2 | 150 | 19 | 245 | 15 |
| 3 | 150 | 19 | 250 | 15 |
| 4 | 160 | 18 | 265 | 14 |

As can be inferred from this Table 2, the aluminum alloys 2, 3, and 4 according to the invention fulfill the required first yield strength $R_{p0.2}$ of 150 MPa as being below 160 MPa and the required second yield strength $R_{p0.2}$ in the range from 250 MPA—this is true even at a comparatively low baking temperature of 165 degrees Celsius in order to achieve the T6 state. In comparison to the aluminum alloys 2, 3, the aluminum alloy 4 containing silver in the T6 state has an increased yield strength $R_{p0.2}$ with a negligibly reduced uniform elongation $A_g$.

In comparison to the aluminum alloy 1, the aluminum alloys 2, 3, and 4 according to the invention feature an alloy that is set in a particular way with regard to the alloy elements Mg, Si, and Zn and the trace elements Sn, Cd, and/or In.

In this way, the alloy elements can advantageously affect the artificial aging of the aluminum alloy in order to ensure all of the required yield strengths $R_{p0.2}$ in the T4 state or T4-FH state and in the T6 state—the latter two yield strengths $R_{p0.2}$ being in the T6 state, even with the use of a low hot tempering temperature, which results in a high paint baking reaction ("paint bake response" or "PER").

Furthermore, in the T4-FH state, all of the aluminum alloys 2, 3, and 4 according to the invention exhibit a high uniform elongation $A_g$ during the forming, in particular cold sheet forming, which permits complex geometries in the molded part.

The uniform elongation $A_g$ of the aluminum alloys 2, 3, and 4 according to the invention in the T6 state is also high, which ensures a high ductility in the molded part. For this reason, the aluminum alloys 2, 3, and 4 according to the invention also have a particularly high suitability for molded parts of the vehicle body.

The invention claimed is:

1. An aluminum sheet or strip composed of a tempered aluminum alloy, the tempered aluminum alloy consisting of:

2.5 to 3.5 wt. % zinc (Zn),
0.5 to 1.5 wt. % magnesium (Mg),
0.2 to 0.8 wt. % silicon (Si),
0.005 to 0.2 wt. % tin (Sn) and/or indium (In) and/or cadmium (Cd), and optionally
up to 0.35 wt. % copper (Cu),
up to 0.3 wt. % silver (Ag),
up to 0.25 wt. % iron (Fe),
up to 0.12 wt. % manganese (Mn),
up to 0.15 wt. % titanium (Ti), and balance aluminum and inevitable impurities where each of the inevitable impurities amounts to at most 0.05 wt. % and the inevitable impurities all together amount to at most 0.15 wt. %, wherein the magnesium (Mg) and silicon (Si) fulfill the relation $$\frac{0.4}{\text{wt. \% Si}} - 0.15 < \text{wt. \% Mg} < \frac{0.7}{\text{wt. \% Si}} - 0.2$$

and the tempered aluminum alloy is in a T4 state with a stabilization annealing treatment T4-FH, having a first yield strength $Rp_{0.2}$ of at most 160 MPa.

2. The aluminum sheet or strip according to claim 1, wherein the tempered aluminum alloy has 2.5 to 3.4 wt. % Zn.

3. The aluminum sheet or strip according to claim 1, wherein the tempered aluminum alloy has 0.8 to 1.2 wt. % Mg.

4. The aluminum sheet or strip according to claim 1, wherein the tempered aluminum alloy has 0.35 to 0.7 wt. % Si.

5. The aluminum sheet or strip according to claim 1, wherein the tempered aluminum alloy has tin (Sn) and/or indium (In) and/or cadmium (Cd), and wherein the tin (Sn) and/or indium (In) and/or cadmium (Cd) has a composition of greater than 40 to less than 400 atomic ppm.

6. The aluminum sheet or strip according to claim 1, wherein the tempered aluminum alloy has 0.15 to 0.35 wt. % copper (Cu) and/or
0.1 to 0.3 wt. % silver (Ag) and/or
0.05 to 0.25 wt. % iron (Fe) and/or
0.05 to 0.12 wt. % manganese (Mn) and/or
0.05 to 0.15 wt. % titanium (Ti) and/or
0.02 to 0.2 wt. % tin (Sn) and/or indium (In) and/or cadmium (Cd).

7. The aluminum sheet or strip according to claim 1, wherein the aluminum sheet or strip has a thickness of 0.5 to 4 mm.

8. A formed part made of the aluminum sheet or strip according to claim 1, wherein the formed part has a second yield strength $Rp_{0.2}$ of at least 250 MPa in an artificial aging state with an aging temperature of at most 165 degrees Celsius.

9. A formed vehicle part made of the aluminum sheet or strip according to claim 1, wherein the formed vehicle part has a second yield strength $Rp_{0.2}$ of at least 250 MPa in an artificial aging state with an aging temperature of at most 165 degrees Celsius.

10. The aluminum sheet or strip according to claim 1, wherein the tempered aluminum alloy has 2.7 to 3.3 wt. % zinc (Zn).

11. The aluminum sheet or strip according to claim 6, wherein the tempered aluminum alloy has 0.25 to 0.35 wt. % copper (Cu).

12. A method for producing a formed part comprising:

providing an aluminum sheet or strip composed of a tempered aluminum alloy having a composition consisting of:

2.5 to 3.5 wt. % zinc (Zn),
0.5 to 1.5 wt. % magnesium (Mg),
0.2 to 0.8 wt. % silicon (Si),
0.005 to 0.2 wt. % tin (Sn) and/or indium (In) and/or cadmium (Cd), and optionally
up to 0.35 wt. % copper (Cu),
up to 0.3 wt. % silver (Ag),
up to 0.25 wt. % iron (Fe),
up to 0.12 wt. % manganese (Mn),
up to 0.15 wt. % titanium (Ti), and balance aluminum and inevitable impurities where each of the inevitable impurities amounts to at most 0.05 wt. % and the inevitable impurities all together amount to at most 0.15 wt. %, wherein the magnesium (Mg) and silicon (Si) fulfill the relation $$\frac{0.4}{\text{wt. \% Si}} - 0.15 < \text{wt. \% Mg} < \frac{0.7}{\text{wt. \% Si}} - 0.2$$

and the tempered aluminum alloy is in a T4 state with a stabilization annealing treatment T4-FH, having a first yield strength $Rp_{0.2}$ of at most 160 MPa;

using the aluminum sheet or strip to produce a sheet blank, producing the formed part from the sheet blank using a sheet-metal-forming method, and in a subsequent step, subjecting the formed part to an artificial aging at a temperature of at most 165 degrees Celsius, wherein the artificially aged formed part has a second yield strength $Rp_{0.2}$ of at least 250 MPa.

13. The method according to claim 12, wherein the formed part is a formed vehicle part.

14. The method according to claim 12, wherein the tempered aluminum alloy has 2.5 to 3.4 wt. % Zn.

15. The method according to claim 12, wherein the tempered aluminum alloy has 0.8 to 1.2 wt. % Mg.

16. The method according to claim 12, wherein the tempered aluminum alloy has 0.35 to 0.7 wt. % Si.

17. The method according to claim 12, wherein the tempered aluminum alloy has tin (Sn) and/or indium (In) and/or cadmium (Cd), and wherein the tin (Sn) and/or indium (In) and/or cadmium (Cd) has a composition of greater than 40 to less than 400 atomic ppm.

18. The method according to claim 12, wherein the tempered aluminum alloy has 0.15 to 0.35 wt. % copper (Cu) and/or
0.1 to 0.3 wt. % silver (Ag) and/or
0.05 to 0.25 wt. % iron (Fe) and/or
0.05 to 0.12 wt. % manganese (Mn) and/or
0.05 to 0.15 wt. % titanium (Ti) and/or
0.02 to 0.2 wt. % tin (Sn) and/or indium (In) and/or cadmium (Cd).

19. The method according to claim 12, wherein the aluminum sheet or strip has a thickness of 0.5 to 4 mm.

20. The method according to claim 12, wherein the tempered aluminum alloy has 2.7 to 3.3 wt. % zinc (Zn).

21. The method according to claim 18, wherein the tempered aluminum alloy has 0.25 to 0.35 wt. % copper (Cu).

* * * * *